US005436445A

United States Patent [19]

Kelley et al.

[11] Patent Number: 5,436,445

[45] Date of Patent: Jul. 25, 1995

[54] MASS SPECTROMETRY METHOD WITH TWO APPLIED TRAPPING FIELDS HAVING SAME SPATIAL FORM

[75] Inventors: Paul E. Kelley, San Jose; John N. Louris, Santa Clara, both of Calif.

[73] Assignee: Teledyne Electronic Technologies, Mountain View, Calif.

[21] Appl. No.: 252,436

[22] Filed: May 31, 1994

Related U.S. Application Data

[63] Continuation-in-part of Ser. No. 67,575, May 25, 1993, Pat. No. 5,381,007, which is a continuation of Ser. No. 34,170, Mar. 18, 1993, abandoned, which is a continuation of Ser. No. 884,455, May 14, 1992, Pat. No. 5,274,233, which is a continuation of Ser. No. 662,191, Feb. 28, 1991, abandoned.

[51] Int. Cl.[6] ..... H01J 49/42

[52] U.S. Cl. ..... 250/282; 250/292

[58] Field of Search ..... 250/282, 292

[56] References Cited

U.S. PATENT DOCUMENTS

| | | | |
|---|---|---|---|
| 2,939,952 | 6/1960 | Paul et al. | 250/41.9 |
| 2,950,389 | 8/1960 | Paul et al. | 250/41.9 |
| 3,065,640 | 11/1962 | Langmuir et al. | 73/517 |
| 3,334,225 | 8/1967 | Langmuir | 250/41.9 |
| 4,450,884 | 9/1985 | Stafford et al. | 250/282 |
| 4,736,101 | 4/1988 | Syka et al. | 250/292 |
| 4,749,860 | 6/1988 | Kelley et al. | 250/282 |
| 4,761,545 | 8/1988 | Marshall | 250/282 |
| 4,771,172 | 9/1988 | Weber-Grabau | 250/282 |
| 4,818,869 | 4/1989 | Weber-Grabau | 250/2892 |
| 4,882,484 | 11/1989 | Franzen et al. | 250/282 |
| 4,975,577 | 12/1990 | Franzen et al. | 250/291 |
| 5,075,547 | 12/1991 | Johnson et al. | 250/292 |
| 5,128,542 | 7/1992 | Yates et al. | 250/292 |
| 5,134,286 | 7/1992 | Kelley | 250/282 |
| 5,171,991 | 12/1992 | Johnson et al. | 250/292 |
| 5,196,699 | 3/1993 | Kelley | 250/282 |
| 5,200,613 | 4/1993 | Kelley | 250/282 |
| 5,227,629 | 7/1993 | Miseki | 250/292 |
| 5,381,007 | 1/1995 | Kelley | 250/282 |

FOREIGN PATENT DOCUMENTS

| | | | |
|---|---|---|---|
| 383961 | 2/1988 | European Pat. Off. | H01J 49/42 |
| 363990 | 4/1988 | European Pat. Off. | H01J 49/42 |
| 180328 | 5/1988 | European Pat. Off. | H01J 49/42 |
| 350159 | 1/1990 | European Pat. Off. | H01J 49/42 |

OTHER PUBLICATIONS

March, et al., "Resonance Excitation of Ions Stored in a Quadrupole Ion Trap, Part 1, . . . ," International J. of Mass Spectrometry and Ion Processes, V. 95, pp. 119–156 (1989).

(List continued on next page.)

*Primary Examiner*—Jack I. Berman

*Attorney, Agent, or Firm*—Limbach & Limbach

[57] ABSTRACT

A mass spectrometry method in which an improved field comprising two or more trapping fields having substantially identical spatial form is established and at least one parameter of the improved field is changed to excite selected trapped ions sequentially for detection. The changing improved field (preferably with a supplemental field superimposed therewith) can sequentially eject selected ones of the trapped ions from the improved field for detection. An improved field comprising two quadrupole trapping fields can be established in a region defined by the ring and end electrodes of a three-dimensional quadrupole ion trap, and the amplitude of an RF (and/or DC) component (and/or the frequency of the RF component) of one or both trapping fields can be changed to sequentially excite trapped ions. Preferably, a trapping field capable of storing ions having mass to charge ratio within a selected range is established, an improved field is established by superimposing the trapping field with a second trapping field of substantially identical spatial form, and a supplemental field is also superimposed with the trapping field to cause at least some of the trapped ions in the trap region to move away from the center of the trap region.

7 Claims, 10 Drawing Sheets

OTHER PUBLICATIONS

Vedel, et al., "Rapid Communication—A Sensitive Method for the Detection of Stored Ions by Resonant Ejection Using a Wide-Band Signal", Int'l. Journal of Mass Spectrometry and Ion Processes, V. 108, pp. R11–R20 (1991).

Vedel, et al., "New Schemes for Resonant Ejection in R.F. Quadrupolar Ion Traps", Int'l. Journal of Mass Spectrometry and Ion Processes, V. 99, pp. 125–138 (1990).

Alfred, et al., "Resonance Excitation of Ions Stored in a Quadrupole Ion Trap, Part IV, . . . ," International J. of Mass Spectrometry and Ion Processes, V. 125, No. 2/3, pp. 171–185 (Jul. 13, 1993).

March, et al., "Resonance Excitation of Ions Stored in a Quadrupole Ion Trap, Part II . . . ," International J. of Mass Spectrometry and Ion Processes, V. 99, pp. 109–124 (1990).

March, et al., "Resonance Excitation of Ions Stored in a Quadrupole Ion Trap, Part III . . . ," International J. of Mass Spectrometry and Ion Processes, V. 110, pp. 159–178 (1991).

March, et al., "Kinetic Energy Effects in an Ion Ensemble . . . ," Organic Mass Spectrometry, V. 28, pp. 499–509 (1993).

MASS SPECTROMETRY METHOD WITH TWO APPLIED TRAPPING FIELDS HAVING SAME SPATIAL FORM

CROSS-REFERENCE TO RELATED APPLICATIONS

The present application is a continuation-in-part of U.S. patent application Ser. No. 08/067,575, filed May 25, 1993, now U.S. Pat. No. 5,381,007 which is a continuation of U.S. patent application Ser. No. 08/034,170, filed Mar. 18, 1993, now abandoned, which is a continuation of U.S. patent application Ser. No. 07/884,455, filed May 14, 1992 (issued as U.S. Pat. No. 5,274,233), which is a continuation of U.S. patent application Ser. No. 07/662,191, filed Feb. 28, 1991 (now abandoned). The text of the prior applications is incorporated herein by reference.

FIELD OF THE INVENTION

The invention relates to mass spectrometry methods in which ions are trapped in an ion trap, and the trapped ions are selectively excited for detection. More particularly, in accordance with the inventive mass spectrometry method, an improved field (comprising two trapping fields having the same spatial form and optionally also a supplemental field) is established in an ion trap, and the improved field is changed to excite selected trapped ions sequentially for detection.

BACKGROUND OF THE INVENTION

Throughout the specification, including in the claims, the phrase "spatial form of a field" (and variations thereon) is used to denote parameters of a field other than a scaling factor for its amplitude (or the amplitude of one or more periodic components thereof) and the phase of one or more periodic components thereof. For example, consider a quadrupole trapping field resulting from application of an RF sinusoidal voltage (having peak-to-peak amplitude V, frequency $\omega$, and a phase) and optionally also a DC voltage, between the ring electrode and one of the end electrodes of a conventional three-dimensional quadrupole ion trap. Two such quadrupole trapping fields (both applied between the ring electrode and an end electrode) will have the same "spatial form" despite differences in their frequencies, phases, DC amplitudes, and/or the peak-to-peak amplitudes of their sinusoidal or other periodic components. However, a supplemental field resulting from application of a sinusoidal or other periodic voltage (and optionally also a DC component) across the end electrodes of a quadrupole trap will have a different spatial form than a quadrupole trapping field (applied between the ring electrode and an end electrode of the trap) due to the different geometries of the ring electrode and the end electrodes.

Throughout the specification, including in the claims, the expression "changing a field," and variations thereon, are used in a broad sense to denote any operation in which at least one parameter of the field is changed, including for example, performing a continuous sweep or scan of at least one parameter of the field, performing a discontinuous or pulsed application of a component of the field, or performing a discontinuous or pulsed variation of at least one parameter of the field.

Each of the expressions "trapping field" and "supplemental field" employed herein denotes a field having at least one periodically varying component. Each periodically varying component can be, but need not be, a sinusoidally varying component.

In some conventional mass spectrometry techniques, a combined field (comprising a trapping field and a supplemental field having different spatial form than the trapping field) is established in an ion trap, and the combined field is changed to excite trapped ions for detection. For example, U.S. Pat. No. 3,065,640 (issued Nov. 27, 1962) describes a three-dimensional quadrupole ion trap (with reference to FIG. 1). It teaches application of DC voltage 2 $V_{dc}$ and AC voltage 2 $V_{ac}$ across the trap's end electrode 13 and ring electrode 11 to establish a quadrupole trapping field in the trap, application of a supplemental voltage (having DC component $V_g$ and AC component 2 $V_\beta$) across the quadrupole trap's end electrodes 12 and 13 to establish a supplemental field in the trap (having different spatial form than the simultaneously applied quadrupole trapping field), and changing of the combined fields by increasing one or both of simultaneously applied voltages $V_g$ and $V_{dc}$ to eject trapped ions from the trap, through a hole 25 through end electrode 12 for detection at an external detector 26 (see col. 3, lines 13–18, and col. 9, lines 9–23).

U.S. Pat. No. 3,065,640 also describes simultaneous establishment of two fields having identical spatial form in the ion trap (the quadrupole trapping field established by "drive" oscillator 18 and DC voltage source 19, and the field established by "pump" oscillator 20 which is connected in series with oscillator 18 and source 19). However, this reference does not suggest changing parameters of two superimposed fields of identical spatial form to excite trapped ions sequentially for detection.

Similarly, U.S. Pat. No. 2,939,952, issued Jun. 7, 1960, suggests (at column 6, lines 17–33) simultaneous establishment of two fields having the same spatial form in an ion trap, but does not disclose or suggest changing parameters of two fields having the same spatial form for the purpose of exciting trapped ions sequentially for detection.

In a class of conventional mass spectrometry techniques known as "MS/MS" methods, ions (known as "parent ions") having mass-to-charge ratio (hereinafter denoted as "m/z") within a selected range are isolated in an ion trap. The trapped parent ions are then allowed or induced to dissociate (for example, by colliding with background gas molecules within the trap) to produce ions known as "daughter ions." The daughter ions are then ejected from the trap and detected.

For example, U.S. Pat. No. 4,736,101, issued Apr. 5, 1988, to Syka, et al., discloses an MS/MS method in which ions (having m/z's within a predetermined range) are trapped within a three-dimensional quadrupole trapping field (established by applying a trapping voltage across the ring and end electrodes of a quadrupole ion trap). The trapping field is then scanned to eject unwanted parent ions (ions other than parent ions having a desired m/z) consecutively from the trap. The trapping field is then changed again to become capable of storing daughter ions of interest. The trapped parent ions are then induced to dissociate to produce daughter ions, and the daughter ions are ejected consecutively (sequentially by mass-to-charge ratio) from the trap for detection.

U.S. Pat. No. 4,736,101 teaches (at column 5, lines 16–42) establishment of a supplemental AC field (having different spatial form than the trapping field) in the trap after the dissociation period, while the trapping voltage is scanned (or while the trapping voltage is held fixed and the frequency of the supplemental AC field is scanned). The frequency of the supplemental AC field is chosen to equal one of the components of the frequency spectrum of ion oscillation, and the supplemental AC field (if it has sufficient amplitude) thus resonantly and sequentially ejects stably trapped ions from the trap as the frequency of each ion (in the changing combined field) matches the frequency of the supplemental AC field.

U.S. Pat. No. 4,761,545, issued Aug. 2, 1988 to Marshall, et al., describes application of a variety of tailored excitation voltage signals to ion traps, including ion cyclotron resonance and quadrupole traps. The tailored excitation voltages have multiple frequency components, and can (through a three step, or optionally five step, tailored computational procedure) have any of a variety of waveforms.

SUMMARY OF THE INVENTION

The invention is a mass spectrometry method in which an improved field (comprising two or more trapping fields having substantially the same spatial form) is established, ions are formed or injected into the improved field and are trapped therein, and at least one parameter of the improved field is changed to excite selected ones of the trapped ions sequentially (such as for detection). The improved field can also include a third component field (sometimes referred to herein as a supplemental field) having different spatial form than the trapping fields. In preferred embodiments, the changing improved field sequentially ejects selected ones of the trapped ions from the improved field for detection (or purposes other than detection). In other embodiments, the changing improved field otherwise sequentially excites the trapped ions for detection (or purposes other than detection).

In preferred embodiments, the improved field is established in a trapping region surrounded by the ring electrode and two end electrodes of a three-dimensional quadrupole ion trap, and the improved field comprises at least two quadrupole trapping fields (of substantially identical spatial form) resulting from application of voltages to one or more of the ring electrode and end electrodes. In these embodiments, the improved field optionally also comprises a supplemental field having different spatial form than the quadrupole trapping fields, resulting from application of at least one supplemental AC voltage across at least one of the end electrodes. The amplitude of an RF (and/or DC) component of the voltage producing one or both of the quadrupole trapping fields (and/or the frequency of the RF component of one or both of the quadrupole trapping fields) can be scanned or otherwise changed while the supplemental AC voltage is applied across the end electrodes (or the quadrupole trapping fields can be held fixed while a parameter of the supplemental AC voltage is scanned or otherwise changed), to sequentially excite ions having a range of mass-to-charge ratios (m/z's) for detection. Application of the supplemental AC voltage as an additional component field of the improved field (in addition to the two component fields having substantially identical spatial form) is useful for exciting selected ions for a variety of purposes, including inducing their reaction or dissociation (particularly in the presence of a buffer gas), or ejecting them from the trap for detection.

Alternatively, a trapping field capable of storing ions having mass to charge ratio within a selected range (corresponding to a trapping range of ion frequencies) is established in a trap region, and a supplemental field is superimposed with the trapping field to eject unwanted ions having mass-to-charge ratio within a second selected range from the improved field. The supplemental field can be a broadband signal having frequency components from a first frequency up to a second frequency wherein the frequency range spanned by the first frequency and the second frequency includes a portion of the trapping range (e.g., it includes a portion of the trapping range from the ion frequency that corresponds to the pump frequency, $\omega_p$, to one half the drive frequency, $\omega$, of the first trapping field), or having frequency components within a lower frequency range from a first frequency up to a notch frequency band, and within a higher frequency range from the notch frequency band up to second frequency, and wherein the frequency range spanned by the first frequency and the second frequency includes the trapping range (optionally, there can be more than one notch frequency band). Then, before or after application of the abovementioned supplemental field, an improved field is established in the trapping region by superimposing the trapping field with at least one additional trapping field of substantially identical spatial form as the trapping field. The improved field can then be changed to sequentially excite trapped ions remaining in the trapping region. Typically, the superimposed trapping fields and the supplemental field are established by applying voltage signals to electrodes of an ion trap apparatus, where the electrodes describe the spatial form of the trapping region.

In a class of preferred embodiments, the relative phase of two or more periodically time-varying component fields of the improved field is controlled to achieve an optimal combination of mass resolution, sensitivity, and mass peak stability during ion detection. Dynamic phase adjustment can be performed during mass analysis (when the improved field of the invention is being changed) to achieve an optimal combination of mass resolution, sensitivity, and mass peak stability during sequential time periods in which each of different ion species are excited for detection. For example, if the improved field consists of two quadrupole trapping fields (produced by two sinusoidal RF voltages) and a supplemental AC field (produced by a sinusoidal supplemental voltage), different optimal relative phases of the two RF voltages (and of each RF voltage and the supplemental voltage) may be produced at different times during a mass analysis operation in which a parameter of the improved field is changed (such as by being scanned).

DETAILED DESCRIPTION OF THE PREFERRED EMBODIMENTS

Figure 1:
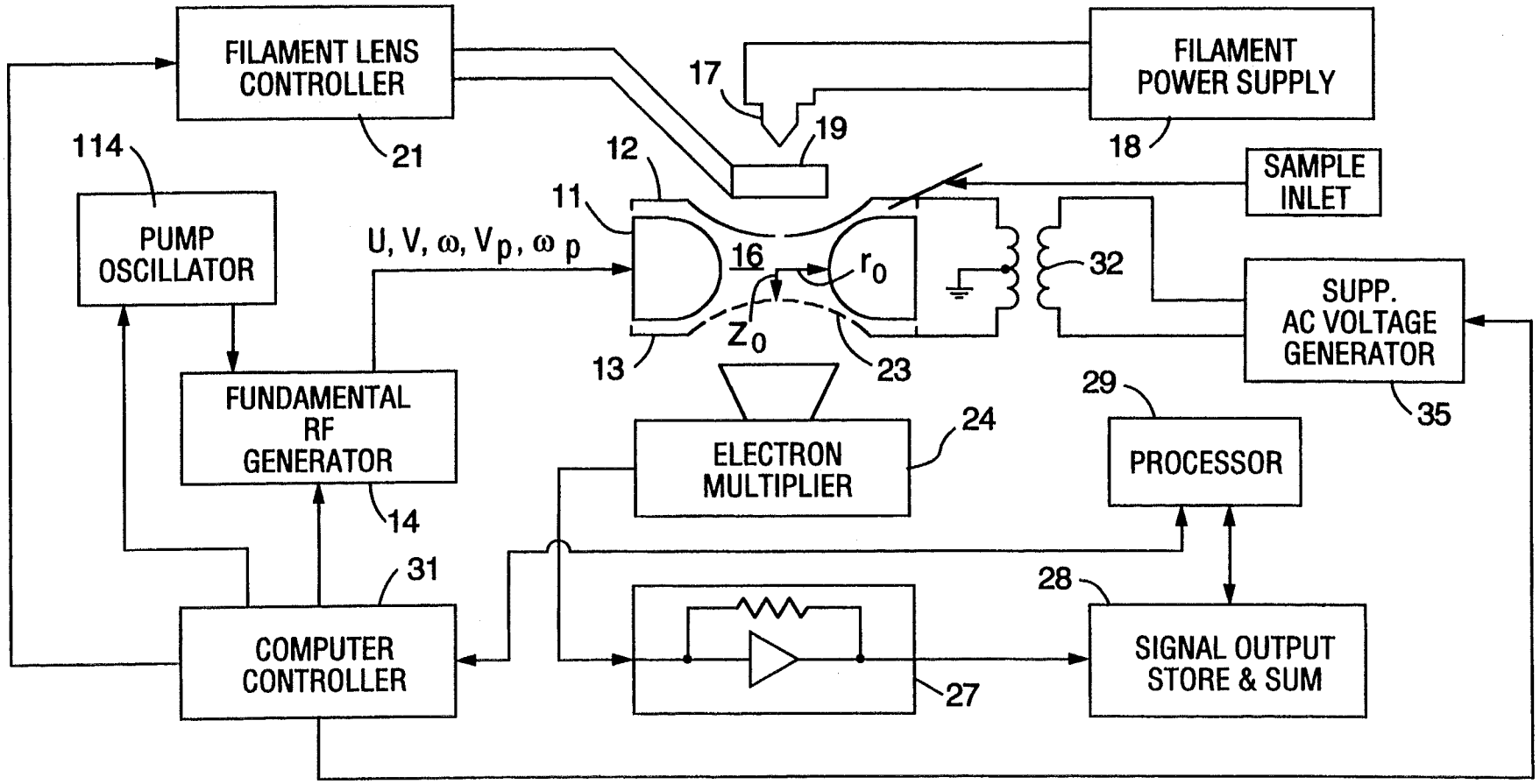
FIG. 1 is a simplified schematic diagram of an apparatus useful for implementing a class of preferred embodiments of the invention.

The quadrupole ion trap apparatus shown in FIG. 1 is useful for implementing a class of preferred embodiments of the invention. The FIG. 1 apparatus includes ring electrode 11 and end electrodes 12 and 13. A first three-dimensional quadrupole trapping field is established in region 16 enclosed by electrodes 11–13, when fundamental voltage generator 14 is switched on (in response to a control signal from control circuit 31) to apply a fundamental voltage between electrode 11 and electrodes 12 and 13. The fundamental voltage comprises a sinusoidal voltage having amplitude V and frequency $\omega$ and optionally also a DC component of amplitude U. $\omega$ is typically within the radio frequency (RF) range.

Ion storage region 16 has radius $r_o$ and vertical (axial) dimension $z_o$. Electrodes 11, 12, and 13 can be common mode grounded through coupling transformer 32.

A second three-dimensional quadrupole trapping field is established in region 16 enclosed by electrodes 11–13, when pump oscillator 114 is switched on (in response to a control signal from control circuit 31) to apply a pump voltage between electrode 11 and electrodes 12 and 13. The pump voltage is a sinusoidal voltage signal having amplitude $V_p$ and frequency $\omega_p$ ($\omega_p$ is typically an RF frequency), and an optional DC component. Alternatively, the pump voltage can be another periodic voltage signal. Pump oscillator 114 is connected in series with voltage generator 14. The first and second three-dimensional quadrupole trapping fields have the same spatial form, but may differ in frequency or phase, or in the amplitude of their RF or DC components. The improved field in region 16 resulting from simultaneous application of the first and second three-dimensional quadrupole trapping fields is characterized by the above-mentioned parameters V, $\omega$, U, $V_p$, and $\omega_p$.

The advantages of employing an improved field in accordance with the invention (as opposed to a single trapping field such as the three-dimensional quadrupole trapping field produced by generator 14 alone) include the following:

- the second trapping field (e.g., a second three-dimensional quadrupole trapping field) can be used to dissociate selected ions (particularly in the presence of a buffer gas);
- the second trapping field (e.g., a second three-dimensional quadrupole trapping field) can be used to effectively increase the m/z range over which ions can be stored or analyzed (the "mass range" of the ion trap), beyond the mass range that could be expected using a limited voltage output generator alone (e.g., a limited voltage output generator 14 alone);
- ions can be excited (e.g., ejected during performance of mass analysis) by a changing improved field whose component fields have lower peak-to-peak voltage than the voltage amplitude that would otherwise be required to make them unstable using a single changed trapping field (by adjusting a field parameter such that the ion's "a" and/or "q" parameters lie outside the stability envelope) so that lower power, and hence less expensive, voltage sources can be employed to implement mass analysis; and
- trapped ion trajectories can be increased more rapidly (i.e., exponentially with time) by changing the inventive improved field than by conventional resonance ejection techniques (which increase such trajectories essentially linearly with time), thus enabling faster scan rates and higher mass resolution than can be achieved by conventional resonance ejection techniques.

The above-mentioned increase in effective mass range of an ion trap can be achieved in a variety of ways. For example, parameters of the second trapping field (produced by a second generator) can be selected to expand the mass range beyond that achievable with a single trapping field produced by a first generator having limited output voltage (e.g., a limited voltage output generator 14 alone). Alternatively, the second trapping field can be applied, and one or more parameters of the first trapping field can then be modified to expand the mass range beyond that achievable with the first trapping field alone.

Supplemental AC voltage generator 35 can be switched on (in response to a control signal from control circuit 31) to apply a desired supplemental AC signal across end electrodes 12 and 13 as shown (or alternatively, between electrode 11 and one or both of electrodes 12 and 13). In preferred embodiments, the supplemental AC signal produced by generator 35 is selected so that the improved field comprising all three of the first and second three-dimensional quadrupole trapping fields, and the field established by the supplemental AC voltage, will excite desired trapped ions for detection (or excite desired trapped ions for other purposes).

One or more parameters (e.g., one or more of V, $\omega$, U, $V_p$, and $\omega_p$) of the improved field resulting from the voltage signals output from both elements 14 and 114 can be changed to sequentially excite desired trapped ions for detection (or for other purposes). Similarly, one or more parameters of the improved field resulting from the voltage signals output from all three of elements 14, 114, and 35 (e.g., one or more of V, $\omega$, U, $V_p$, $\omega_p$, and the frequency or frequencies and peak-to-peak amplitude or amplitudes of generator 35's output) can be changed to sequentially excite desired trapped ions for detection (or for other purposes).

Filament 17, when powered by filament power supply 18, directs an ionizing electron beam into region 16 through an aperture in end electrode 12. The electron beam ionizes sample molecules within region 16, so that the resulting ions can be trapped within region 16 by the first quadrupole trapping field and/or the second quadrupole trapping field. Cylindrical gate electrode and lens 19 is controlled by filament lens control circuit 21 to gate the electron beam off and on as desired. Alternatively, ions can be created externally and injected into the trapping region.

In one embodiment, end electrode 13 has perforations 23 through which ions can be ejected from region 16 for detection by an externally positioned electron multiplier detector 24. Electrometer 27 receives the current signal asserted at the output of detector 24, and converts it to a voltage signal, which is summed and stored within circuit 28, for processing within processor 29.

In a variation on the FIG. 1 apparatus, perforations 23 are omitted, and an in-trap detector is substituted. Such an in-trap detector can comprise the trap's end electrodes themselves. For example, one or both of the end electrodes could be composed of (or partially composed of) phosphorescent material (which emits photons in response to incidence of ions at one of its surfaces). In another class of embodiments, the in-trap ion detector is distinct from the end electrodes, but is mounted integrally with one or both of them (so as to detect ions that strike the end electrodes without introducing significant distortions in the shape of the end electrode surfaces which face region 16). One example of this type of in-trap ion detector is a Faraday effect detector in which an electrically isolated conductive pin is mounted with its tip flush with an end electrode surface (preferably at a location along the z-axis in the center of end electrode 13). Alternatively, other kinds of in-trap ion detectors can be employed, such as ion detectors which do not require that ions directly strike them to be detected (examples of this latter type of detector, which shall be denoted herein as an "in-situ detector," include resonant power absorption detection means, and image current detection means).

The output of each in-trap detector is supplied through appropriate detector electronics to processor 29.

In embodiments of the invention, the supplemental AC voltage signal from generator 35 can be omitted. In other embodiments, a supplemental AC signal of sufficient power can be applied to the ring electrode (rather than to the end electrodes) to induce ions to leave the trap in radial directions (i.e., radially toward ring electrode 11) rather than in the z-direction. Application of a high power supplemental signal to the trap in this manner to eject unwanted ions out of the trap in radial directions before detecting other ions using a detector mounted along the z-axis can significantly increase the operating lifetime of the ion detector, by avoiding saturation of the detector during application of the supplemental signal.

If one or both of the superimposed first and second quadrupole trapping fields has a DC component, the improved field will have both a high frequency and low frequency cutoff, and will be incapable of trapping ions with frequencies of oscillation below the low frequency cutoff or above the high frequency cutoff.

Control circuit 31 generates control signals for controlling fundamental voltage generator 14, filament control circuit 21, pump oscillator 114, and supplemental AC voltage generator 35. Circuit 31 sends control signals to circuits 14, 21, 114, and 35 in response to commands it receives from processor 29, and sends data to processor 29 in response to requests from processor 29.

Control circuit 31 preferably includes a digital processor or analog circuit, of the type which can rapidly create and control the frequency-amplitude spectrum of each supplemental voltage signal asserted by supplemental AC voltage generator 35 (or a suitable digital signal processor or analog circuit can be implemented within generator 35). A digital processor suitable for this purpose can be selected from commercially available models. Use of a digital signal processor permits rapid generation of a sequence of supplemental voltage signals having different frequency-amplitude spectra.

The invention is a mass spectrometry method in which in an improved field (comprising two or more trapping fields having the same spatial form) is established, ions are trapped in the improved field, and at least one parameter of the improved field is changed to excite selected ones of the trapped ions sequentially (such as for detection). The improved field optionally includes a supplemental field (which may have a different spatial form than the trapping fields) in addition to the trapping fields. In preferred embodiments, the changing improved field sequentially ejects selected ones of the trapped ions from the improved field for detection (or purposes other than detection) In other embodiments, the changing improved field otherwise sequentially excites the trapped ions for detection (or purposes other than detection).

In preferred embodiments, the improved field is established in a trapping region surrounded by the ring electrode and two end electrodes of a three-dimensional quadrupole ion trap, and the improved field comprises at least two quadrupole trapping fields (of substantially identical spatial form) resulting from application of voltages to one or more of the electrodes. In these embodiments, the improved field optionally also comprises a supplemental field having different spatial form than the quadrupole trapping fields, resulting from application of a supplemental AC voltage across the end electrodes. The amplitude of an RF (and/or DC) component of the voltage producing one or both of the quadrupole trapping fields (and/or the frequency of the RF component frequency of one or more of the quadrupole trapping fields) can be scanned (or otherwise changed) while the supplemental AC voltage is applied across the end electrodes (or one or more of the quadrupole trapping fields can be held fixed while a parameter of the supplemental AC voltage is scanned or otherwise changed), to sequentially excite ions having a range of mass-to-charge ratios for detection.

Alternatively, a trapping field capable of storing ions having mass to charge ratio within a selected range (corresponding to a trapping range of ion frequencies) is established in a trap region, and a supplemental field is superimposed with the trapping field to eject unwanted ions having mass-to-charge ratio within a second selected range from the improved field. The supplemental field can be a broadband signal having frequency components from a first frequency up to a second frequency wherein the frequency range spanned by the first frequency and the second frequency includes a portion of the trapping range (e.g., it includes a portion of the trapping range from the ion frequency that corresponds to the pump frequency, $\omega_p$, to one half the drive frequency, $\omega$, of the first trapping field), or having frequency components within a lower frequency range from a first frequency up to a notch frequency band, and within a higher frequency range from the notch frequency band up to second frequency, and wherein the frequency range spanned by the first frequency and the second frequency includes the trapping range (optionally, there can be more than one notch frequency band). Such a supplemental field can eject ions from the trap (other than selected ions), thereby preventing storage of undesired ions which might otherwise interfere with subsequent mass spectrometry operations. After application of the supplemental field, an improved field can be established in the trapping region by superimposing the trapping field with at least one additional trapping field having substantially identical spatial form as the trapping field. Alternatively, the improved field can be established before or during application of the supplemental field.

In a final step, the improved field can be changed (typically after switching off the supplemental field, but alternatively during application of the original supplemental field or another supplemental field) to sequentially excite selected trapped ions remaining in the trapping region. In the final step, one or more parameters of the improved field (including both trapping fields and optionally also a supplemental field) can be changed to sequentially excite trapped ions in a manner for implementing an $(MS)^n$ mass analysis operation, where n=2, 3, 4, or more. In such an $(MS)^n$ operation, the improved field can be changed (for example, by switching off and on the supplemental field component of the improved field) to induce dissociation of parent or daughter ions, and then changed in a different manner to perform mass analysis of daughter ions.

In the above-described embodiments, the two trapping fields and the supplemental field can be established by applying voltage signals to ion trap apparatus electrodes which surround the trapping region. In preferred embodiments, one of the trapping fields is a quadrupole field determined by a sinusoidal fundamental voltage signal having a DC voltage component (of amplitude U) and an RF voltage component (of amplitude V and frequency $\omega$) applied to one or more of the ring electrode and end electrodes of a quadrupole ion trap, the other trapping field is a quadrupole field determined by a sinusoidal pump voltage signal (of amplitude $V_p$ and frequency $\omega_p$) applied to the same electrode (or electrodes) of the quadrupole ion trap, and in the final step one or more of parameters V, $\omega$, U, $V_p$, and $\omega_p$ of the improved field are changed to sequentially excite desired trapped ions for detection (or for other purposes). In other embodiments, the other trapping field is itself a superposition of two or more quadrupole fields, each determined by a sinusoidal pump voltage signal (of amplitude $V_p$ and frequency $\omega_p$) applied to the same electrode (or electrodes) of the quadrupole ion trap as is the first trapping field. In the final step of the latter embodiments, one or more of parameters V, $\omega$, U, or any of the $V_p$ and $\omega_p$ parameters, are changed to sequentially excite desired trapped ions.

In variations on the above-described embodiments, the supplemental field can have two or more notch frequency bands. For example, the supplemental field can have frequency components within a low frequency range from a first frequency up to a first notch frequency band, within a middle frequency range from the first notch frequency band to a second notch frequency band, and within a high frequency range from the second notch frequency band up to a second frequency. For many mass analysis applications, each of the supplemental field's frequency components preferably has an amplitude in the range from 10 mV to 10 volts.

In preferred embodiments, a buffer or collision gas (such as, but not limited to, Helium, Hydrogen, Argon, or Nitrogen) is introduced into the trapping region to improve mass resolution and/or sensitivity and/or trapping efficiency of externally generated ions. The buffer or collision gas can also be removed before mass analysis to improve sensitivity and/or mass resolution during ion ejection and/or detection.

In alternative embodiments of the invention, the improved field comprises two hexapole (or higher order multipole) trapping fields of substantially identical spatial form (e.g., both are hexapole fields or both are octopole fields). The multipole trapping fields can be established by applying sinusoidal (or other periodic) fundamental and pump voltages (produced by series-connected voltage sources) to the electrodes of a hexapole (or higher order multipole) ion trap.

In a class of preferred embodiments, the relative phase of two or more periodically time-varying component fields of the improved field is controlled to achieve an optimal combination of mass resolution, sensitivity, and mass peak stability during ion detection. Dynamic phase adjustment can be performed during any portion of an experiment, including mass analysis (when the improved field of the invention is being changed) to achieve an optimal combination of mass resolution, sensitivity, and mass peak stability during sequential time periods in which each of different ion species are excited or excited for detection. For example, if the improved field consists of two quadrupole trapping fields (produced by two sinusoidal RF voltages) and a supplemental AC field (produced by a sinusoidal supplemental voltage), different optimal relative phases of the two RF voltages (and of each RF voltage and the supplemental voltage) may be produced at different times during a mass analysis operation in which a parameter of the improved field is swept or scanned.

In any of the embodiments of the invention:

- while changing the improved field, the rate of change of one or more of the parameters thereof can be controlled to achieve a desired mass resolution;
- an automatic sensitivity or gain control method (such as described in U.S. Pat. No. 5,200,613, issued Apr. 6, 1993) can be employed while changing the improved field;
- the electron multiplier is protected from damage by deflecting or otherwise preventing unwanted ions from entering it or reducing the gain of the detector;
- non-consecutive mass analysis can be performed while changing the improved field (e.g., the improved field can be changed by superimposing a sequence of supplemental AC fields thereon, with each supplemental field having a frequency selected to excite ions of an arbitrarily selected m/z ratio);

the improved field can include a supplemental field having a frequency-amplitude spectrum selected to eliminate interferences, for example due to leakage of permeable gases into a sealed ion trap (such as one sealed by O-rings) or bleed peaks from a separation column connected to the device, with a mass analysis operation;

the improved field can include at least two "pump" fields and a fundamental trapping field (all of substantially identical spatial form) selected so that the improved pump fields define a frequency-amplitude spectrum including one or more notches at frequency bands appropriately selected to perform a desired mass spectrometry operation, such as selected storage of wanted m/z's or mass ranges, a chemical ionization (CI) operation or a selected reagent ion CI operation, or while protecting the ion detector from damage due to the presence of unwanted ions;

in the presence of the improved field, the energy of electrons to be introduced into an ion trap can be controlled so that the electrons do not create unwanted ions (such as by ionizing collision, CI, and/or solvent gas in the trap and/or an associated vacuum chamber);

an improved field (comprising one or more "pump" fields as well as a fundamental trapping field, and all having substantially identical spatial form) can be established in an ion cyclotron resonance (ICR) trap, and the improved field can be changed to excite ions in the ICR trap for detection or other purposes;

different gas pressure can be maintained in the ion injection transport system, the ion trap, and/or the ion detector, to optimize the performance of the overall analysis;

an ion trap or vacuum system can be used which has O-rings or permeable membranes designed for supplying atmospheric gasses into the region of the improved field, and one or more of the gasses can be ionized and selectively stored for use in performing CI or charge exchange reactions, or the unionized gasses can enable collisional dissociation or cooling of trapped ions; and in an ion trap mass spectrometer which has an electrode structure which can store and/or mass analyze ions, and functions as the vacuum chamber of the mass spectrometer, the improved field can be designed to have a frequency-amplitude spectrum for removing unwanted ions from within the electrode structure.

Figure 2:
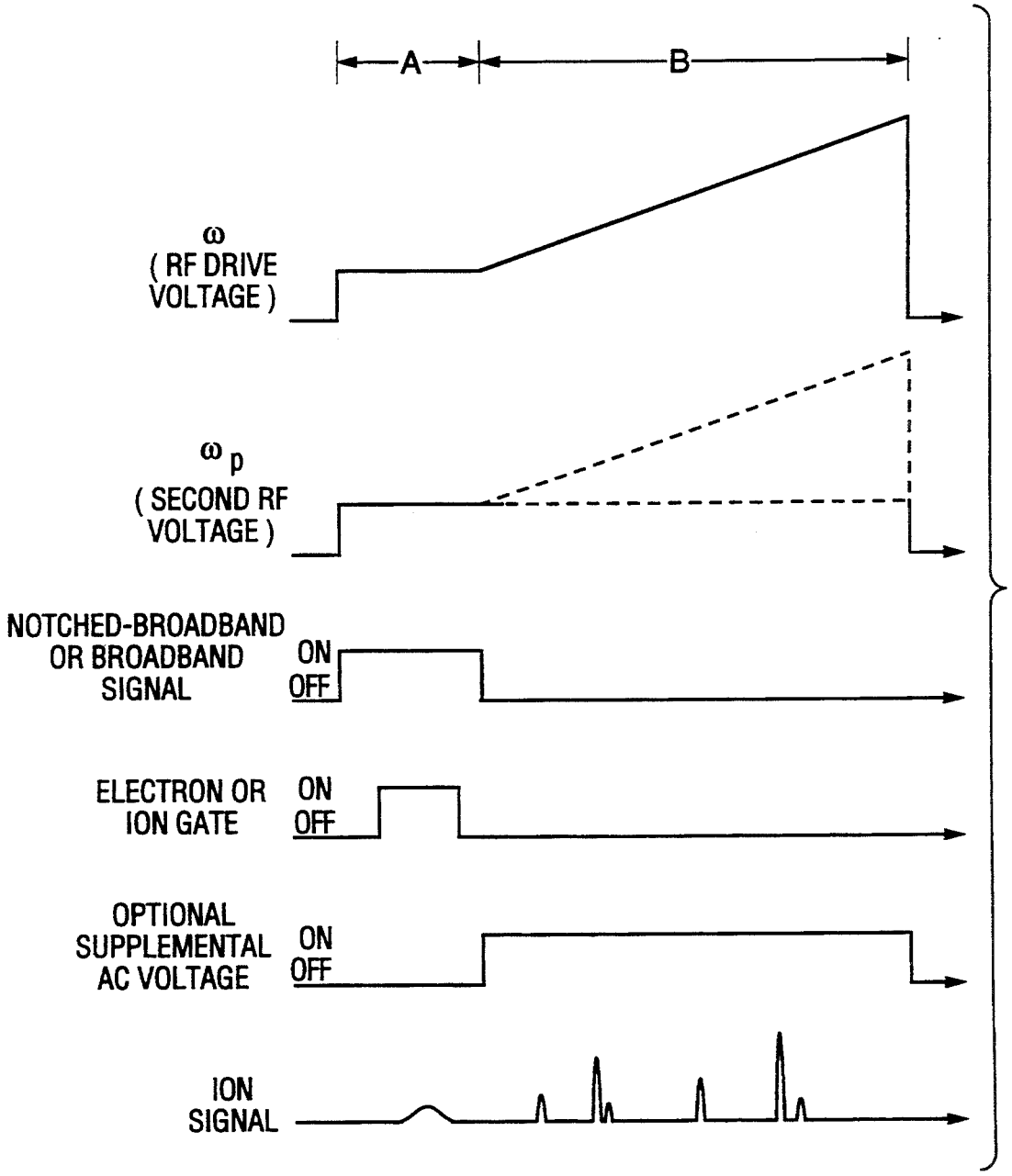
FIG. 2 is a diagram of one preferred embodiment of the invention.

A preferred embodiment of the inventive method will be described with reference to FIG. 2. As indicated in FIG. 2, the first step of this method (which occurs during period "A") is to store selected ions in a trap. This can be accomplished by applying an RF drive voltage signal to the trap (by activating generator 14 of the FIG. 1 apparatus) to establish a first quadrupole trapping field, simultaneously applying a second RF voltage signal to the trap (by activating pump oscillator 114 of the FIG. 1 apparatus) to establish a second quadrupole trapping field (having the same spatial form as the first quadrupole trapping field), and introducing an ionizing electron beam into ion storage region 16 (to create ions which will selectively escape from the trap or become stably trapped in the trap). Alternatively, the ions can be externally produced and injected into storage region 16 during period A.

The second quadrupole trapping field creates a hole or place of instability in the stability diagram of the first quadrupole trapping field. An axial excitation condition will exist whenever $\omega_z = N\omega_p/2$ where $\omega_z$ is the frequency of ion motion in the axial (Z) direction and N is an integer.

Also during period A, a broadband voltage signal (which can be a notch-filtered broadband voltage signal) is applied to the trap (such as by activating supplemental generator 35 of FIG. 1) to eject undesired ions from the trap.

Ions produced in (or injected into) trap region 16 during period A which have a mass-to-charge ratio outside a desired range or ranges (determined by the combination of the broadband signal and the two trapping fields fundamental voltage signal) will escape from region 16, possibly causing detector 24 to produce an output signal as they escape, as indicated by the peak in the "ion signal" in FIG. 2 during period A.

Before the end of period A, the ionizing electron beam (or ion beam) is gated off.

After period A, mass analysis and detection is performed during period B. During period B, an optional supplemental AC voltage signal can be applied to the trap (such as by activating generator 35 of the FIG. 1 apparatus or a second supplemental AC voltage generator connected to the appropriate electrode or electrodes). The frequency of the optional supplemental AC signal is preferably about half the frequency $\omega_p$ of the second RF voltage signal, to aid ejection for detection of trapped ions during period B.

Also during period B, trapped ions are sequentially excited for detection by changing one or more of the peak-to-peak amplitude of the RF drive voltage signal (or the amplitude of a DC component thereof), the peak-to-peak amplitude of the second RF voltage signal (or the amplitude of a DC component thereof), and the frequency $\omega$ of the RF drive voltage signal. If the peak-to-peak amplitude of the second RF voltage is scanned, it should be in the range from about 0.1% to 10% of the peak-to-peak amplitude of the RF drive voltage. The second quadrupole field can be used (by choosing an appropriate $\omega_p$ with $V_p$) to extend the mass range by causing ions to become excited and exit the ion trap at lower peak-to-peak amplitudes of the RF drive voltage signal, as compared to using only a single three-dimensional quadrupole field. The step of changing at least one parameter of the superimposed fields during period B successively excites trapped ions having different m/z (mass-to-charge) ratios for detection (for example, by electron multiplier 24 shown in FIG. 1). The "ion signal" portion shown within period B of FIG. 2 has six peaks, representing sequentially detected ions having six different mass-to-charge ratios.

Automatic sensitivity correction can be performed preliminary to period A, to determine an optimal time for the electron (or ion) gate and an optimal electron current for period A.

Another preferred embodiment of the inventive method will be described with reference to FIG. 3. The FIG. 3 method is identical to that described above with reference to FIG. 2, except as follows.

Figure 3:
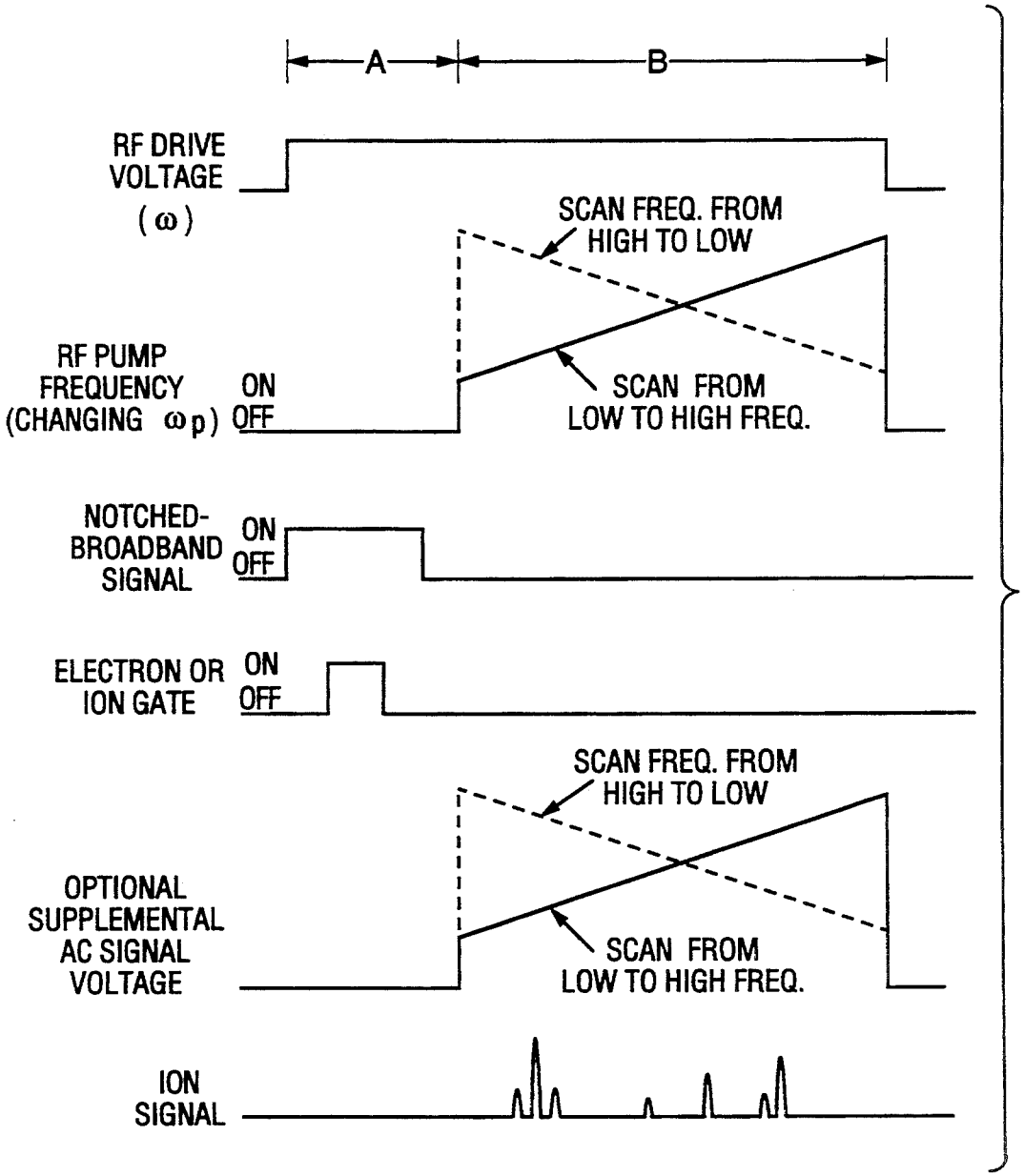
FIG. 3 is a diagram of a second preferred embodiment of the invention.

During period B of the FIG. 3 method, trapped ions are sequentially excited for detection by sweeping or scanning the frequency $\omega_p$ of the second RF voltage signal (while holding substantially constant the peak-to-peak amplitude of the RF drive voltage signal and the second RF voltage signal, and the frequency $\omega$ of the RF drive voltage signal). By scanning the frequency $\omega_p$ of the second RF voltage signal from low to high frequency, trapped ions are sequentially excited in order of high m/z ratio to low m/z ratio, and by scanning the frequency $\omega_p$ of the second RF voltage signal from high to low frequency, trapped ions are sequentially excited in order of low m/z to high m/z.

Also, it is optional to apply a supplemental AC voltage signal to the trap during period B of the FIG. 3 method (such as by activating generator 35 of the FIG. 1 apparatus). If the supplemental AC signal is applied, its frequency is preferably scanned synchronously with the scanned frequency $\omega_p$ of the second RF voltage signal. The frequency of the supplemental AC signal is scanned from low to high if frequency $\omega_p$ of the second RF voltage signal is scanned from low to high, and the frequency of the supplemental AC signal is scanned from high to low if frequency $\omega_p$ of the second RF voltage signal is scanned from high to low.

In the FIG. 3 method, the step of sweeping or scanning the frequency $\omega_p$ of the second RF voltage signal (and optionally also the frequency of the supplemental AC signal) during period B successively excites trapped ions having different m/z (mass-to-charge) ratios for detection (for example, by electron multiplier 24 shown in FIG. 1). The "ion signal" portion shown within period B of FIG. 3 has seven peaks, representing sequentially detected ions having seven different mass-to-charge ratios.

Another embodiment of the inventive method, for implementing an MS/MS operation, will next be described with reference to FIG. 4. Period A of the FIG. 4 method is identical to above-described period A of the FIG. 2 method. During period A, parent ions are stored in the trap.

The RF drive voltage signal (including its optional DC component) and the second RF voltage signal are chosen so as to store (within region 16) parent ions (such as parent ions resulting from interactions between sample molecules and the ionizing electron beam) as well as daughter ions (which may be produced during period "B") having m/z ratio within a desired range.

Application of a notch-filtered broadband signal ejects from the trap ions, produced in (or injected into) trap region 16 during period A, which have a mass-to-charge ratio outside a desired range determined by the combination of the notch-filtered broadband signal and the two other voltages applied during period A.

After period A, during period B, a supplemental AC voltage signal is applied to the trap (such as by activating generator 35 of the FIG. 1 apparatus or a second supplemental AC voltage generator connected to the appropriate electrode or electrodes). The amplitude (output voltage applied) of the supplemental AC signal is lower than that of the notch-filtered broadband signal applied in period A (typically, the amplitude of the supplemental AC signal is on the order of 100 mV while the amplitude of the notch-filtered broadband signal is on the order of 1 to 10 V). The supplemental AC voltage signal has a frequency or band of frequencies selected to induce dissociation of a particular parent ion (to produce daughter ions therefrom), but has amplitude (and hence power) sufficiently low that it does not resonate significant numbers of the ions excited thereby to a degree sufficient for in-trap or out-of-trap detection or ejection.

Next, during period C, the daughter ions are sequentially detected. This can be accomplished, as suggested by FIG. 4, by changing one or more of the peak-to-peak amplitude of the RF drive voltage signal (or the amplitude of a DC component thereof), the peak-to-peak amplitude of the second RF voltage signal (or the amplitude of a DC component thereof), the frequency $\omega$ of the RF drive voltage signal, or the frequency $\omega_p$ of the second RF voltage signal, to successively eject daughter ions having different mass-to-charge ratios from the trap for detection (for example, by electron multiplier 24 shown in FIG. 1). The "ion signal" portion shown within period C of FIG. 4 has four peaks, each representing sequentially detected daughter ions having a different mass-to-charge ratio.

If out-of-trap daughter ion detection is employed during period C, the daughter ions are preferably ejected from the trap in the axial direction toward a detector (such as electron multiplier 24) positioned along the z-axis.

Figure 4:
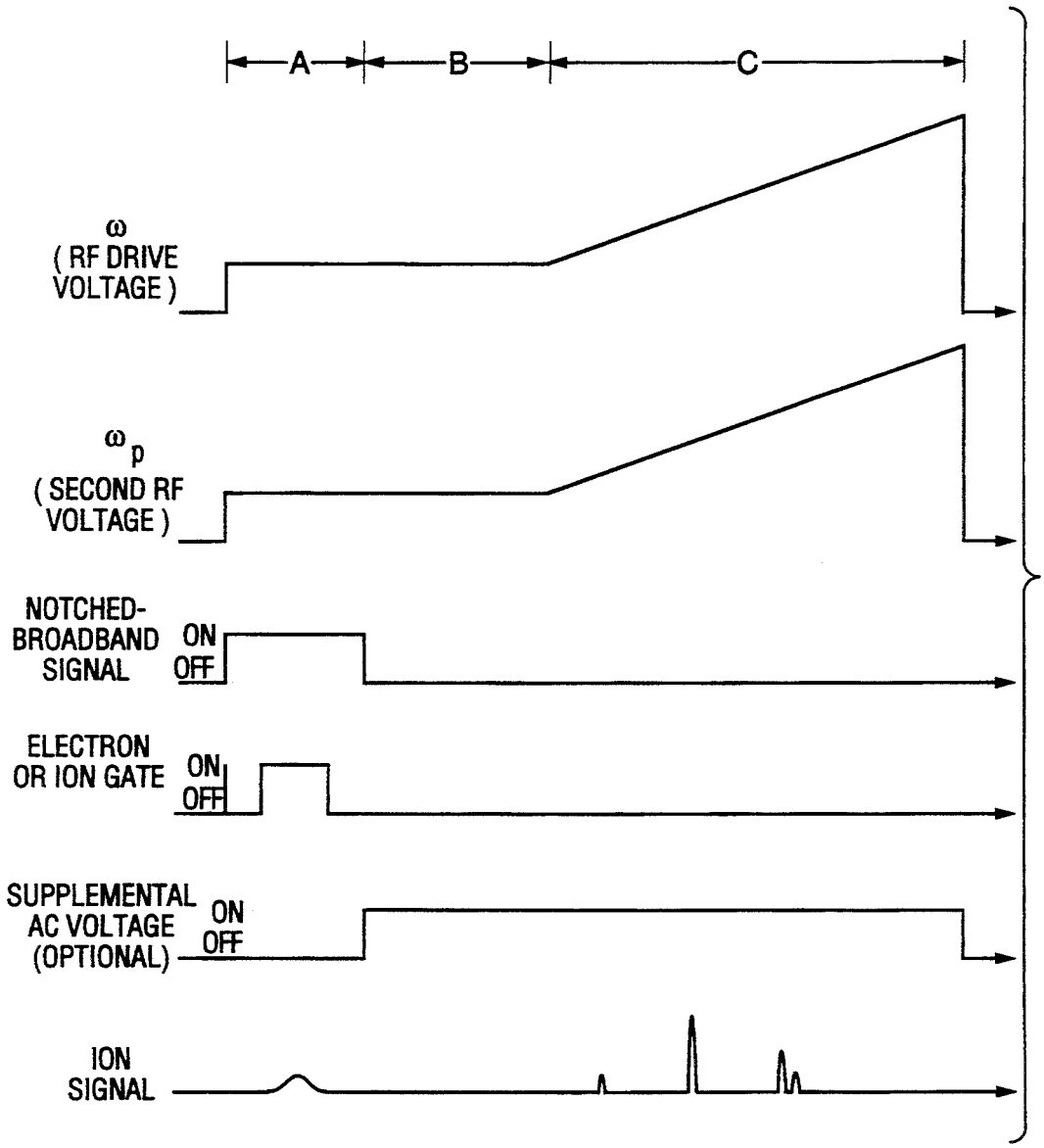
FIG. 4 is a diagram of a third preferred embodiment of the invention.

In the FIG. 4 method, the second RF voltage signal can optionally be off during period A. Also, the frequency and amplitude of the second RF voltage signal can be chosen to dissociate selected parent ions during period B to form daughter ions. During period C, the frequency and amplitude of the second RF voltage signal are appropriately chosen to accomplish mass analysis. The frequency and amplitude of the second RF voltage signal can be different in period B than in period C.

The FIG. 4 method described above is an MS/MS method. In variations on the FIG. 4 method, period B can implement simultaneous $(MS)^n$, where n is an integer greater than 2, or additional periods can be performed between periods B and C (of FIG. 4) to implement sequential $(MS)^n$, where n is an integer greater than 2.

Another embodiment of the inventive method, for implementing a chemical ionization (CI) experiment, will next be described with reference to FIG. 5. Period A of the FIG. 5 method is identical to above-described period A of the FIG. 2 method.

During period A, CI reagent ions are created and selectively stored within trap region 16.

After period A, during period B, sample molecules are permitted to react with reagent ions that have been stably trapped during period A. Product ions resulting from this reaction are stored in the trap region (if their mass-to-charge ratios are within the range capable of being stored by the superimposed trapping fields (due to the RF drive voltage and the second RF voltage) established during period A and maintained during period B.

Next, during period C, selected parent ions are stored in the trap. If the superimposed trapping fields (due to the RF drive voltage and the second RF voltage) were not established so as to be capable of storing such daughter ions during period A, then during period C they are changed so as to become capable of storing the daughter ions (as indicated by the change in the RF drive voltage signal and the second RF voltage signal as shown between periods B and C of FIG. 5). Also during period C, a second notch-filtered broadband signal is applied to the trap to resonate out of the trap unwanted ions having mass-to-charge ratio other than that of desired product ions produced during period B.

After period C, during period D, a supplemental AC voltage signal is applied to the trap (such as by activating generator 35 of the FIG. 1 apparatus or a second supplemental AC voltage generator connected to the appropriate electrode or electrodes). The power (output voltage applied) of the supplemental AC signal is lower than that of the notch-filtered broadband signal applied in period C (typically, the power of the supplemental AC signal is on the order of 100 mV while the power of the notch-filtered broadband signal is on the order of 1 to 10 V). The supplemental AC voltage signal has a frequency or band of frequencies selected to induce dissociation of a particular stored product ion (to produce daughter ions therefrom), but has amplitude (and hence power) sufficiently low that it does not resonate significant numbers of the ions excited thereby to a degree sufficient for in-trap or out-of-trap detection or ejection.

Next, during period E,-the daughter ions are sequentially detected. This can be accomplished, as suggested by FIG. 5, by changing one or more of the peak-to-peak amplitude of the RF drive voltage signal (or the amplitude of a DC component thereof), the peak-to-peak amplitude of the second RF voltage signal (or the amplitude of a DC component thereof), the frequency $\omega$ of the RF drive voltage signal, or the frequency $\omega_p$ of the second RF voltage signal, to successively excite daughter ions having different mass-to-charge ratios from the trap for detection (for example, by electron multiplier 24 shown in FIG. 1). The "ion signal" portion shown within period E of FIG. 5 has four peaks, each representing sequentially detected daughter ions having a different mass-to-charge ratio.

If out-of-trap product ion detection is employed during period E, the product ions are preferably ejected from the trap in the z-direction (the axial direction) toward a detector (such as electron multiplier 24) positioned along the z-axis.

During the period which immediately follows period E, all voltage signal sources (and the ionizing electron beam) can be switched off. The inventive method can then be repeated.

Figure 5:
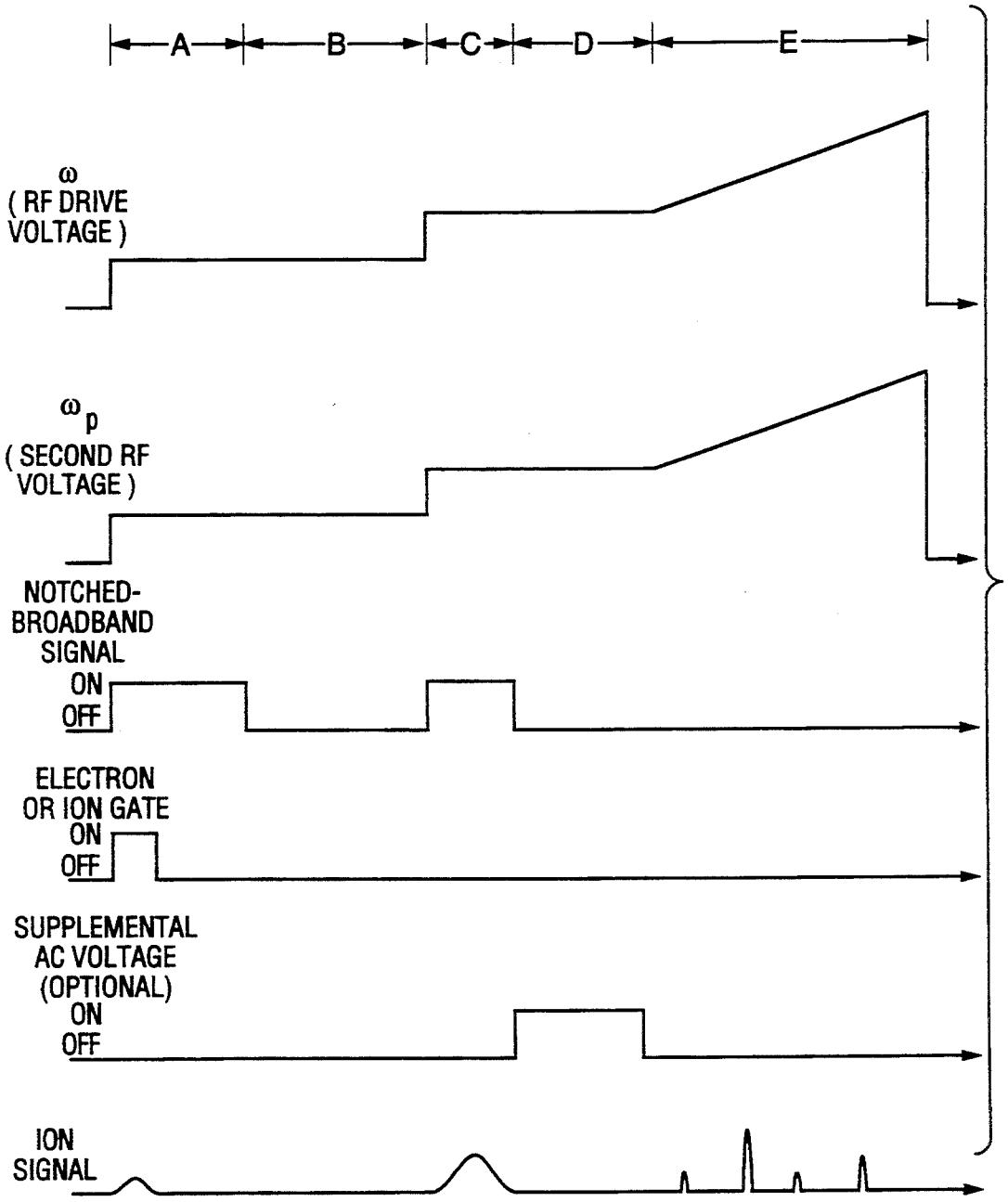
FIG. 5 is a diagram of a fourth preferred embodiment of the invention.

The FIG. 5 method described above is a CI/MS/MS method. In variations on the FIG. 5 method, periods C and D can be deleted, to implement a CI operation. In other variations, periods C and D can implement simultaneous $(MS)^n$, where n is an integer greater than 2, or additional periods can be performed between periods B and E (of FIG. 5) to implement sequential $(MS)^n$, where n is an integer greater than 2.

In the FIG. 5 method, the second RF voltage signal can optionally be off during periods A, B, C, and D. Also, the frequency and amplitude of the second RF voltage signal can be chosen to dissociate selected parent ions during period D to form daughter ions. During period E, the frequency and amplitude of the second RF voltage signal are appropriately chosen to accomplish mass analysis. In period A, the trapping field established by the second RF voltage signal can be used to isolate selected CI reagent ions. In period C, the trapping field established by the second RF voltage signal can be used to isolate selected parent ions. The supplemental AC voltage shown in FIG. 5 can optionally be applied during period E to improve mass resolution and sensitivity during mass analysis.

In preferred embodiments, the invention is a method of scanning a three-dimensional quadropole ion trap (a "Paul" trap) for mass analysis. The inventive method makes use of a "pump" oscillator summed with the RF drive oscillator to eject ions for detection. The pump oscillator causes exponential ion trajectory growth and allows for mass range extension and increased mass resolution.

The use of a pump oscillator with a three-dimensional quadropole ion trap was first described in detail by Langmuir et al. in above-cited U.S. Pat. No. 3,065,640. These workers used the term "pump oscillator" for a second RF voltage source in series with the RF trapping potential. U.S. Pat. No. 2,939,952 to Paul et al. also mentioned this type of field, and more recently, March and co-workers examined various aspects of pump excitation using numerical models (see International Journal of Mass Spectrometry and Ion Processes, 99 (1990), pp. 109–124).

The addition of a pump oscillator to the RF trapping field forms a field which is composed of two trapping fields that have the same spatial form within the ion trap. Ions trapped in this field can be ejected for detection through parametric (quadrupolar) excitation. To date, most commercial ion trap systems have used a supplemental AC dipole field (a tickle) to eject ions for detection. When the frequency of this field matches the natural frequency of ion motion (the secular frequency) a resonance condition is established. The ions oscillate with an amplitude that increases linearly with time and eventually leave the trap.

The pump oscillator effects ejection by a different mechanism that is known as "parametric excitation" or "parametric resonance". Parametric resonance is not brought about by setting the frequency of the pump oscillator to one of the natural frequencies of motion (as determined from the Mathieu equation). Instead, parametric resonance is most efficient when the frequency of the pump oscillator is twice the Mathieu secular frequency. Excitation of ions with the pump oscillator results in an exponential increase in amplitude in the oscillations in the axial direction. In essence, the pump oscillator inserts a region of instability into the stability diagram of the RF drive oscillator.

Figure 6:
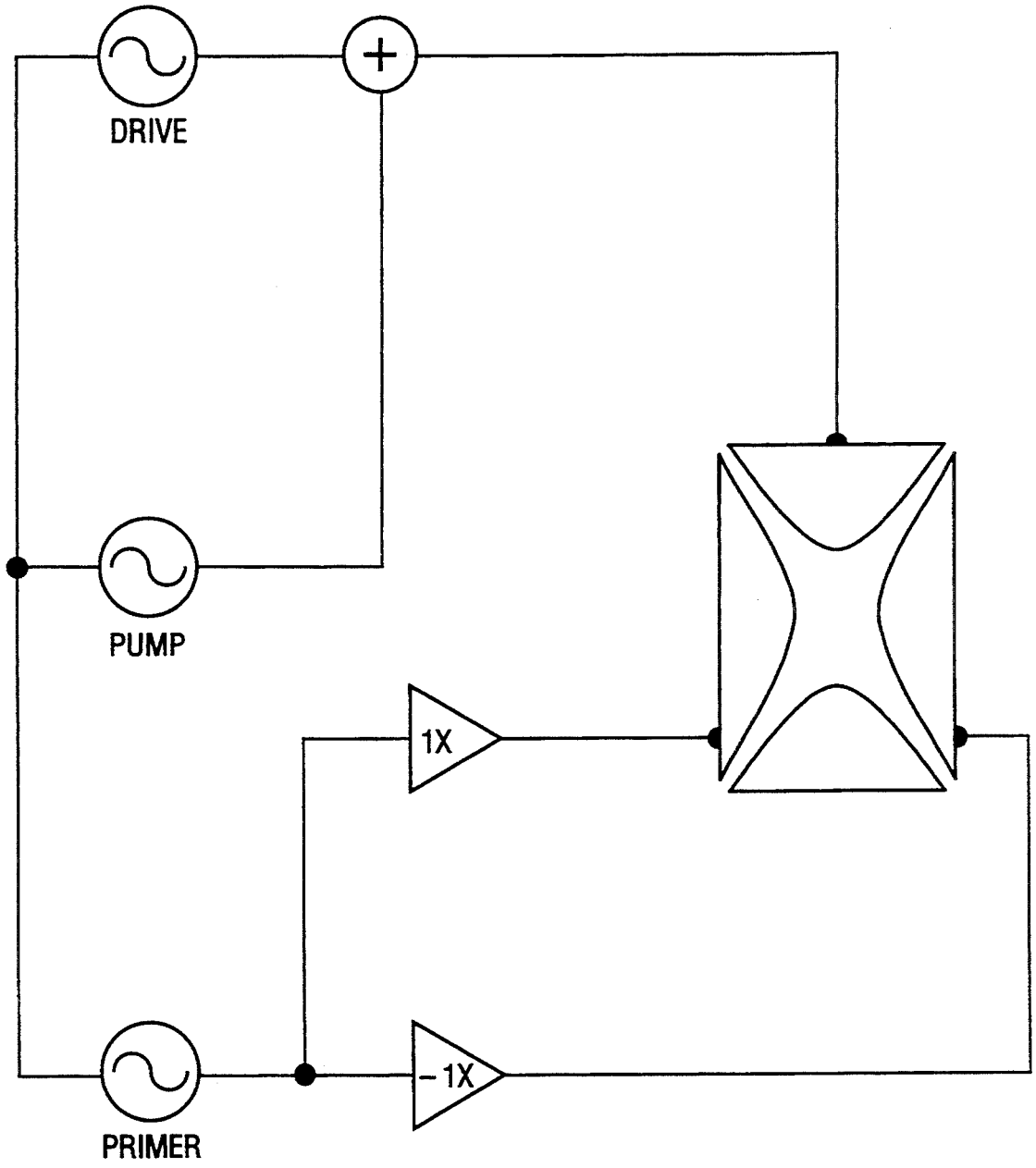
FIG. 6 is a simplified schematic diagram of an apparatus useful for implementing a class of preferred embodiments of the invention.
Figure 7:
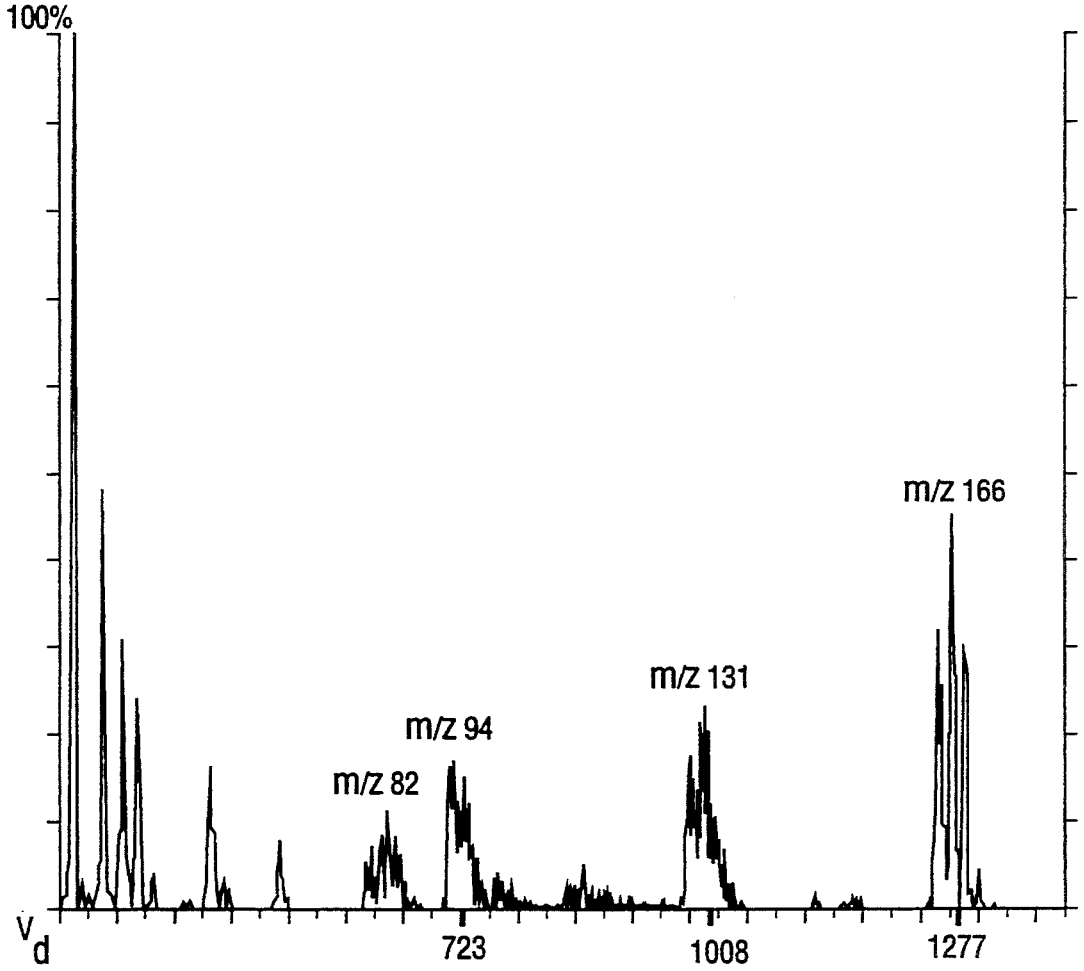
FIG. 7 is a mass spectrum (of $C_2Cl_4$, MW: 164) acquired without application of either a pump voltage or a primer (tickle) voltage. Ion abundance is plotted as a function of the peak voltage of the RF field at the time of ion ejection from the trap. The molecular ion cluster is ejected at about 1277 volts.
Figure 8:
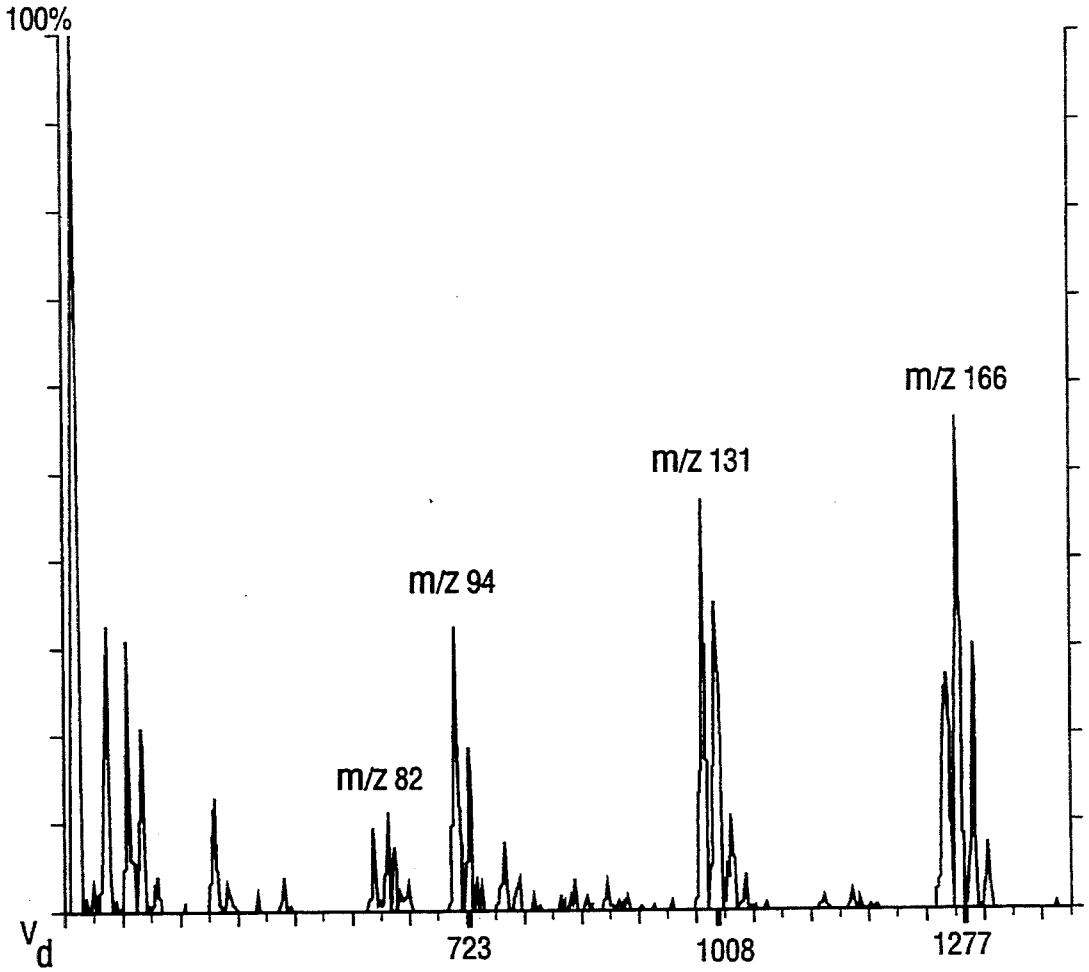
FIG. 8 is a mass spectrum (of $C_2Cl_4$) acquired without application of a pump voltage but with application of a small tickle voltage. The tickle voltage was insufficient to cause ejection, and the molecular ion cluster was detected at the same RF field as in the absence of a tickle voltage. However, the tickle does not have a marked effect on the mass resolution.
Figure 9:
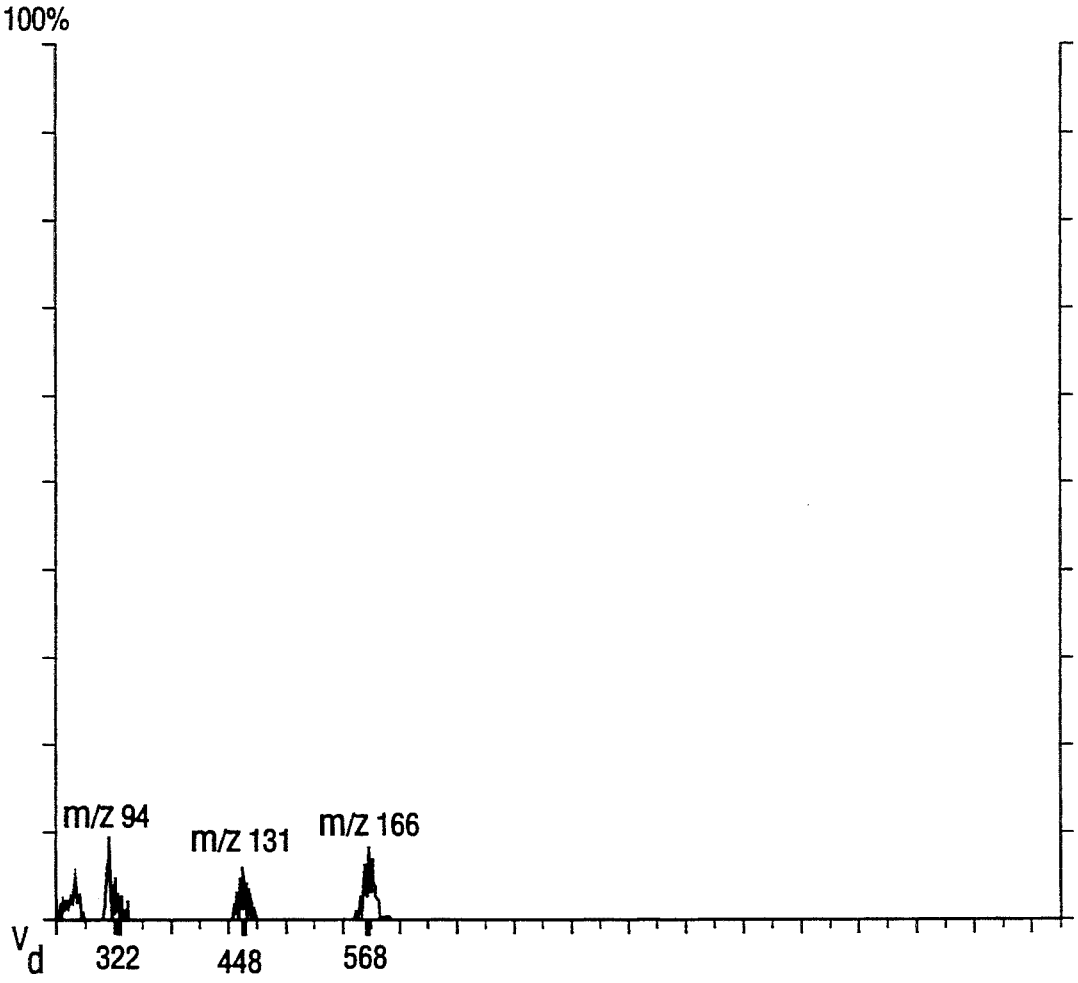
FIG. 9 is a mass spectrum acquired with application of a pump voltage but without application of a tickle voltage. The molecular ion cluster was ejected at an RF field of about 568 V, so that the effective mass range is extended. However, the mass resolution is poor.
Figure 10:
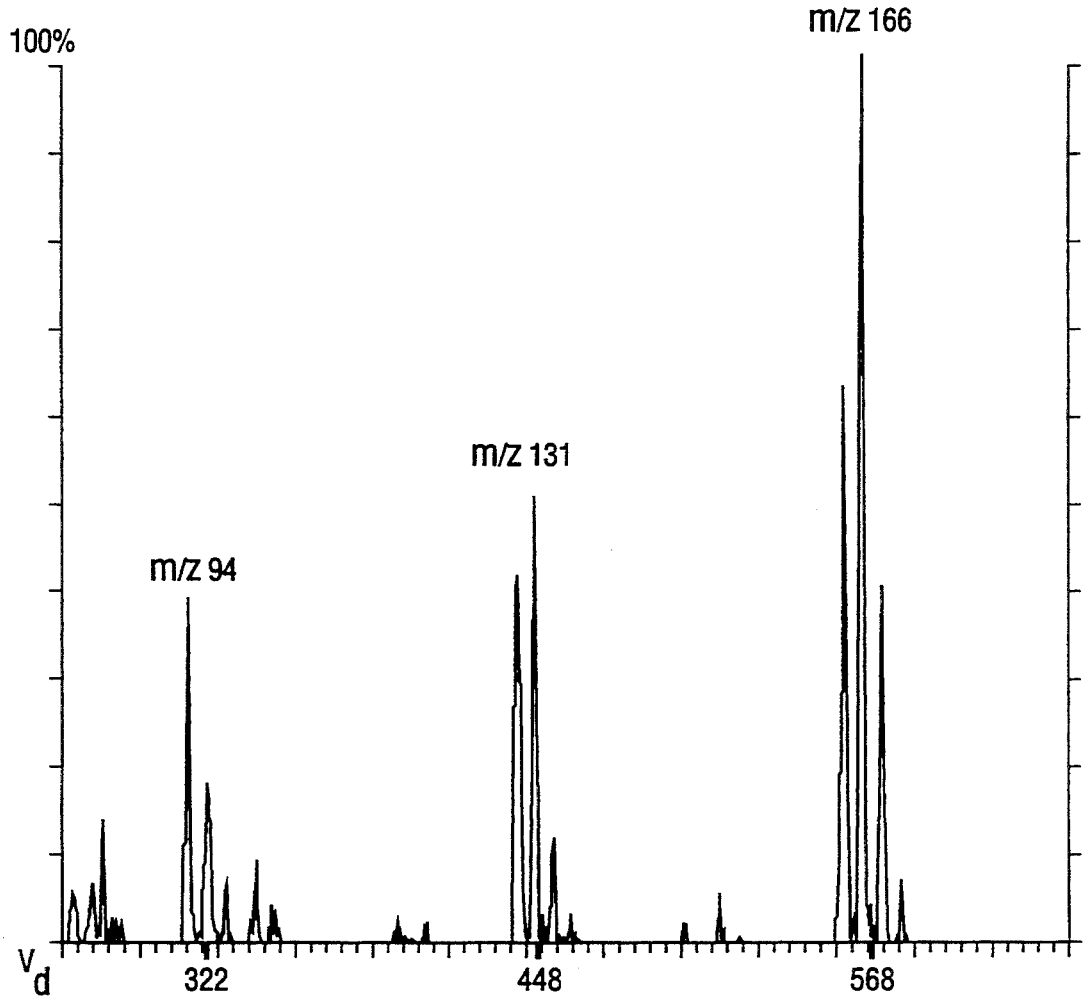
FIG. 10 is a mass spectrum acquired with application of both a pump voltage and a primer (tickle) voltage in accordance with the invention. Ion ,ejection is effected by parametric excitation with the pump voltage. The mass range is extended (from 650 u to 1450 u) by the pump voltage, while the mass resolution is enhanced by the tickle voltage.

A mass spectrum can be acquired using a pump oscillator by ramping the RF voltage (e.g., of the output of the oscillator labeled "Pump" in FIG. 6) so that ions are ejected from the trap as they are subjected to parametric excitation. The attainable mass range in such a "pump scan" can be extended as desired by the choice of the pump frequency. Also, the mass resolution can be increased by decreasing the scan rate.

The pump oscillator is an RF voltage source (e.g., the source labeled "Pump" in FIG. 6) used to produce a second quadropole field within the trap. In the FIG. 6 apparatus we use the RF power amplifier that produces the RF drive voltage (labeled "Drive" in FIG. 6) to sum the pump and the drive voltages. The output from this amplifier is applied to a tank circuit that is tuned to the frequency of the drive voltage so that a high drive voltage can be generated.

Because the frequency of the pump is much different from the frequency of the drive, the tuned circuit is relatively inefficient at boosting the pump voltage. Fortunately, only a small amplitude of pump voltage is needed and the scheme works well.

We also apply the voltage from a third oscillator (labeled "Primer" in FIG. 6) to the end electrodes. This "primer" or "tickle" voltage is generated by splitting the signal and inverting the signal for one of the end electrodes. (A balun transformer is not used.) One preferred embodiment of the invention is performed using the FIG. 6 apparatus with the following parameters:

| Instrument: | Teledyne 3DQ Discovery TM |
|---|---|
| RF Drive Frequency ($\Omega_d$): | 900 kHz |
| RF Drive Voltage ($V_d$): | 0–5 kV |
| Pump Oscillator Frequency ($\Omega_p$): | 300 kHz |
| Pump Oscillator Voltage ($V_p$): | $\approx$5% of $V_d$ |
| Primer Oscillator Frequency ($\Omega_\beta$): | 150 kHz |
| Primer Oscillator Voltage ($V_\beta$): | 0–2 V |
| Electron Ionization Time: | 100 μs |
| Emission Current: | 50 μA |
| Scan Rate: | 53, 120 500 μs/u |

The initial kinetic energy of the ions is preferably removed with a background pressure of approximately $10^{-3}$ torr of helium in the ion trap.

In the absence of either a pump oscillator or a dipole oscillator, and for a constant drive voltage, $V_d$, a charged particle in a Paul trap has a Mathieu equation as the equation of motion. The frequency components of the solution of this equation are useful in characterizing the ion trajectories. Even in experiments in which $V_d$ is ramped, the Mathieu equation describes the ion motion, at least approximately.

Another very useful approximation is that the particle oscillates with simple harmonic motion. (The approximation is valid when no DC component is applied and when the Mathieu parameter $q_z$ is less than 0.5.) Wuerker et al. showed in 1959 (J. of Applied Physics, 30 (1959), pp. 342–349) that the particle oscillates at a subharmonic $\omega_z$, of the drive frequency, $\Omega_d$, so that $$\omega_z \approx q_z \Omega_d / 2(2)^{\frac{1}{2}}.$$

Thus the Mathieu equation can be replaced by the simpler form, $$d^2z/dt^2 + \omega_z^2 z = 0, \text{ for } q_z < 0.5.$$

If a pump oscillator is added, then the equation of motion becomes $$d^2z/dt^2 + [\omega_z^2 - (e/m)\,(2V_p/z_o^2)\,(\text{Cos}\,\omega_p t)z = 0.$$

The pump oscillator is said to cause "parametric excitation" because if effectively induces a time variation in a parameter in the equation of motion. This equation is again a Mathieu equation and can be reduced to the canonical form, $$d^2z/d\xi^2 = (a_p - 2q_p \text{Cos}\,2\xi)z = 0,$$

by the substitutions of $\xi = \Omega_p t/2$; $a_p = 4(\omega_z/\Omega_p)^2$; and $q_p = 4(e/m)\,(V_p/z_o^2)\,(1/\Omega_p^2)$.

When $\Omega_p = 2\omega_z$, then $a_p = 1$, and the first parametric instability region of the Mathieu equation is realized. (This type of instability is also the basis of parametric oscillators in mechanical and electrical engineering.) From the known form of the solution of the Mathieu equation and with appropriate substitutions, $$z_p(t) = \{\exp\,[(Vp/Vd)\,(\Omega t/2(2)^{\frac{1}{2}})]\}\,[\sin\,\omega_z t \ldots],$$

showing that the amplitude increases exponentially with time, while the particle oscillates at the frequency $\omega_z$. However, the ejection process must be "primed" by displacing the particle from the center of the trap, because the pump oscillator does not affect the field at $z=0$.

The pump scan is a useful method of acquiring a mass spectrum with a Paul trap. We find that the mass range of the trap can be extended by the appropriate choice of the pump frequency and that the resolution can be enhanced by decreasing the scan rate. As is expected for a parametric oscillator, the oscillation must be started by some means other than the parametric excitation itself. We find that the addition of a small dipole field (e.g., the output of the oscillator labeled "Primer" in FIG. 6) increases the resolution in the pump scan, presumably because the parametric oscillation is promoted by moving the ions away from the center of the trap.

The parametric oscillation can also be started ("primed") in other ways. For example, a dipole oscillator of less than half the pump frequency would probably prime the pump, because the trajectories would not immediately dampen to the center of the trap (in the time between dipole excitation and pump excitation). Even a second pump oscillator might be similarly used. As the RF voltage is ramped upward, the second pump oscillator would (inefficiently but adequately) prime the first pump. A DC voltage applied between the end electrodes (in place of the "Primer" oscillator of FIG. 6) might also prime the pump, by simply shifting the average position of the ions away from the center of the trap.

A key characteristic of pump excitation is the exponential increase in the amplitude of the trajectory with time, as compared with the linear increase of the better-known dipole excitation.

Various other modifications and variations of the described method of the invention will be apparent to those skilled in the art without departing from the scope and spirit of the invention. Although the invention has been described in connection with specific preferred embodiments, it should be understood that the invention as claimed should not be unduly limited to such specific embodiments.

What is claimed is:

1. A mass spectrometry method, including the steps of:

(a) establishing a trapping field capable of storing ions having mass to charge ratio within a selected range in a trap region;

(b) superimposing at least one additional trapping field with the trapping field to form an improved field in the trap region, where the trapping field and each said additional trapping field have substantially identical spatial form; and (c) changing the improved field to sequentially excite trapped ions having different mass to charge ratios in the trap region while detecting the ions excited by said step of changing the improved field, while superimposing a supplemental field with the improved field to cause at least some of the trapped ions in the trap region to move away from the center of the trap region.

2. The method of claim 1, wherein the supplemental field is a time varying field, and wherein the trapping field and the supplemental field have different spatial form.

3. The method of claim 1, wherein the supplemental field is a DC field.

4. The method of claim 1, wherein the trapping field is a quadrupole trapping field resulting from application of a voltage to at least one electrode of a quadrupole ion trap apparatus, said at least one additional trapping field is a quadrupole trapping field resulting from application of a second voltage to said at least one electrode, and the supplemental field is a dipole field.

5. The method of claim 4, wherein the supplemental field has a frequency substantially equal to half that of said at least one additional trapping field.

6. The method of claim 4, wherein the supplemental field has a frequency equal to less than half that of said at least one additional trapping field.

7. The method of claim 1, wherein the supplemental field is a time varying field, and wherein the trapping field and the supplemental field have substantially identical spatial form.

* * * * *